United States Patent [19]

Kuhlmann

[11] 4,425,656

[45] Jan. 10, 1984

[54] COVER FOR ELECTRIC-ARC CRUCIBLE

[75] Inventor: Herbert Kuhlmann, Bochum, Fed. Rep. of Germany

[73] Assignee: SIDEPAL S.A. Societe Industrielle de Participations Luxembourgeoise, Luxembourg, Luxembourg

[21] Appl. No.: 351,995

[22] Filed: Feb. 24, 1982

[30] Foreign Application Priority Data

Nov. 28, 1981 [DE] Fed. Rep. of Germany ..... 3147338

[51] Int. Cl.[3] ..... F27D 1/12; F27D 1/18

[52] U.S. Cl. ..... 373/74; 432/238

[58] Field of Search ..... 373/74, 73; 432/237, 432/238; 110/331, 335

[56] References Cited

U.S. PATENT DOCUMENTS 1,992,465 2/1935 Blagg ..... 373/74

4,273,949 6/1981 Fischer et al. ..... 373/74

FOREIGN PATENT DOCUMENTS 2048445 12/1980 United Kingdom ..... 373/74

*Primary Examiner*—Roy N. Envall, Jr.

*Attorney, Agent, or Firm*—Karl F. Ross; Herbert Dubno

[57] ABSTRACT

A cover for a metallurgical vessel comprises an annular outer tubular collar defining a center, a plurality of tubular legs extending inwardly from the collar toward the center, and an annular inner tubular collar fixed to the legs and defining a plurality of throughgoing passages. The inner collar is formed by respective inwardly concave tubular sections defining the passages and respective inwardly convex and tubular elbow sections carried on the legs between the passages and forming an undulating annulus with the inwardly concave sections. A multiplicity of cooling tubes extend between the collars and legs and are connected thereto, and a cooler is provided for circulating a coolant through the tubes, collars, and legs. This system ensures excellent cooling right at the passages, so electrodes extending through these passages need not be provided with their own coolers.

6 Claims, 3 Drawing Figures

COVER FOR ELECTRIC-ARC CRUCIBLE

FIELD OF THE INVENTION

The present invention relates to a cover for a metallurgical vessel. More particularly this invention concerns such a cover for an electric-arc crucible.

BACKGROUND OF THE INVENTION

A cover for a metallurgical crucible in which metal is melted or treated in molten condition normally must be cooled to protect it from the extremely high temperatures reigning in the vessel or crucible. Accordingly it is standard to make such a cover as an annular and tubular outer ring or collar supporting an array of cooling tubes and to circulate a coolant such as water or steam through the collar and tubes.

It is frequently necessary to provide one or more holes in the cover so that a lance or electrodes can be inserted through it, and so that gases can be drawn out of the crucible through the cover. In an electric-arc device in particular it is necessary to provide three such openings for the electrodes of standard three-phase system. These electrodes heat up a great deal themselves, so it is standard practice to provide relatively large openings formed by substantial metallic rings in good heat-transmitting engagement with the cooling tubes, and to use separate cooled jacket on each electrode. Thus each electrode with its own cooling device is fitted on the respective ring.

It has also been suggested in German patent document No. 2,917,755 (British Pat. No. 2,048,445) to use a refractory center piece in the cover, and to form it with the necessary electrode holes. Such an arrangement, although in principle substantially simpler than the other above-described system, has a relatively short service life because the ceramic insert and the metallic cover have different coefficients of thermal expansion. Thus they work against each other, normally with the result of cracking the insert.

OBJECTS OF THE INVENTION

It is therefore an object of the present invention to provide an improved cover for a metallurgical vessel.

Another object is the provision of such a cover for a metallurgical vessel which overcomes the above-given disadvantages.

A further object is to provide a cover for an electric-arc crucible which makes special provision for electrodes passing through the cover and which is relatively simple in construction.

SUMMARY OF THE INVENTION

These objects are attained according to the instant invention in a cover for a metallurgical vessel which comprises an annular outer tubular collar defining a center, a plurality of tubular legs extending inwardly from the collar toward the center, and an annular inner tubular collar fixed to the legs and defining a plurality of throughgoing passages. According to the instant invention the inner collar is formed by respective inwardly concave tubular sections defining the passages and respective inwardly convex and tubular elbow sections carried on the legs between the passages and forming an undulating annulus with the inwardly concave sections. A multiplicity of cooling tubes extend between the collars and legs and are connected thereto, and means is provided for circulating a coolant through the tubes, collars, and legs.

Thus in the system according to the invention the structural elements forming the electrode passages are themselves constituted as tubes through which a coolant is circulated. The various tubes are all of the same material, normally steel, and therefore have approximately the same coefficient of expansion so that the system can be expected to have a long service life. In addition the system of this invention ensures excellent cooling right at the passages, so that the electrodes need not be provided with their own coolers.

According to another feature of this invention at least one second cooling tube distinct from the first-mentioned cooling tubes extends along the inner collar on the side turned toward the outer collar. Such an arrangement is useful in extremely high-temperature applications to protect the cover at this critical passage area.

In order to provide a further passage for, say a gas-evacuation assembly the cover has a center collar concentric with the outer collar, lying within the inner collar, and formed of center-collar tubes connected to the inner collar and to the means for circulation of the coolant through the inner and outer collars. The electrode passages are angularly equispaced at the same radial spacing around the center, so that the arrangement of this invention is quite compact and, in fact, represents the ideal arrangement of the central vent opening and the electrodes.

In accordance with another feature of this invention the center-collar tubes have vertical tube sections and U-caps connecting same together. Thus the vertical tube sections define a cylinder concentric with the outer collar. In this manner the central passage is also cooled.

It is also possible according to this invention to provide heat-resistant tiles secured to the inner collar at the passages. These protect the central-collar tubes from abrasion.

DESCRIPTION OF THE DRAWING

The above and other features and advantages will become more readily apparent from the following, reference being made to the accompanying drawing in which.

SPECIFIC DESCRIPTION

Figure 1:
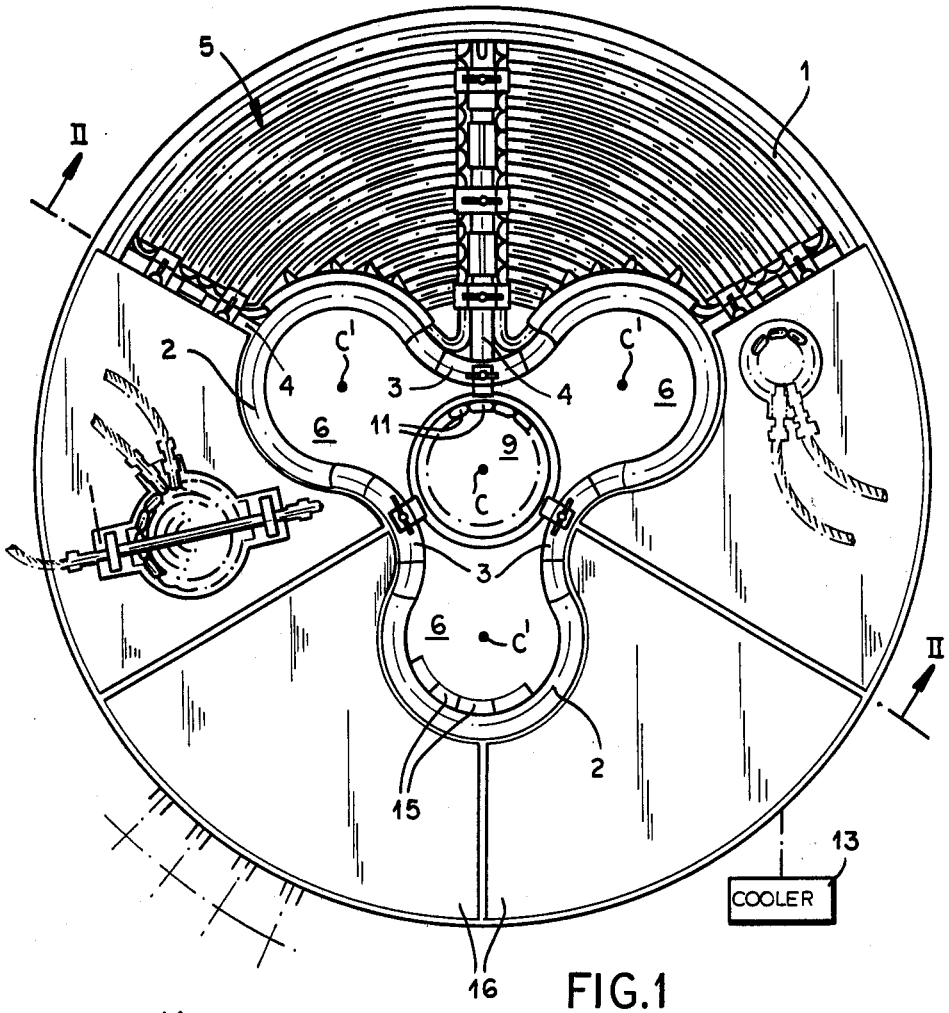
FIG. 1 is a top view partly broken away showing the cover according to this invention.
Figure 2:
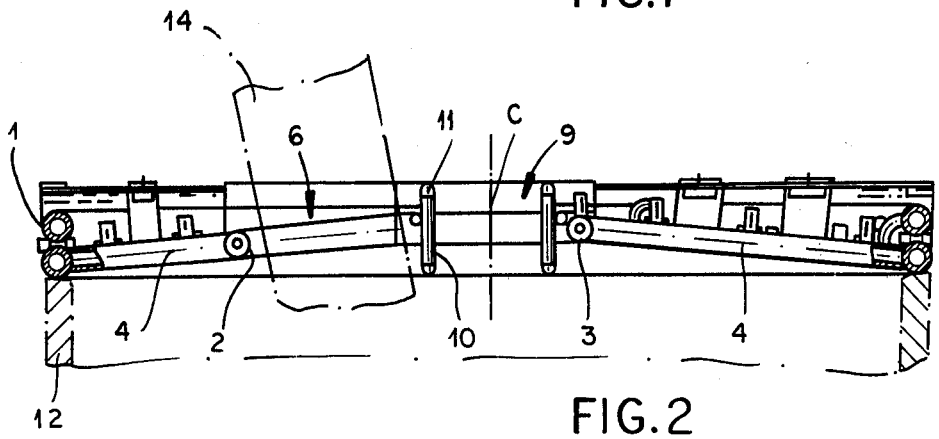
FIG. 2 is a section taken along line II—II of FIG. 1.

As seen in FIGS. 1 and 2 a cover for a refractory vessel shown in dot-dash lines at 12 basically comprises a circular outer collar 1 formed of steel tubing with a center C, a plurality of inwardly radially extending legs 4 also formed of tubing, and a central collar formed of tubing sections 2 and 3. A multiplicity of arcuate and angularly extending small-diameter cooling tubes 5 are connected together and to the collar 1, legs 4, and inner collar 2, 3 so that a cooler 13 connected in conventional manner to them can circulate a coolant such as water or steam through them.

According to this invention the sections 2 of the inner collar are arcuate, extending over somewhat more than 180° about respective centers C′ of respective throughgoing holes or passages 6 angularly and radially equispaced about the center C. They are interconnected by inwardly convex elbow sections 3 and the sections 2 and 3 are carried on the inner ends of the respective legs 4 so that a coolant can be circulated through them too. These passages 6 permit electrodes shown schematically at 14 to be inserted into the crucible 12 through the cover.

In addition the assembly forms another hole 9 at the center C and formed by vertical tube sections 10 interconnected meander-fashion by end caps 11. These tube sections 10 can therefore also have a coolant circulated through them from the elbow sections 3. This passage 9 is perfectly positioned to receive an exhaust conduit for venting gases generated under the cover away.

Refractory tiles such as shown at 15 in FIG. 1 can be secured in the passages 6 and 9 to protect them against abrasion. Such tiles can be individually secured to the respective tube sections each by a single respective bolt or the like so that the problem of the tiles and tube sections working against each other because of their different coefficients of thermal expansion is largely eliminated.

Figure 3:
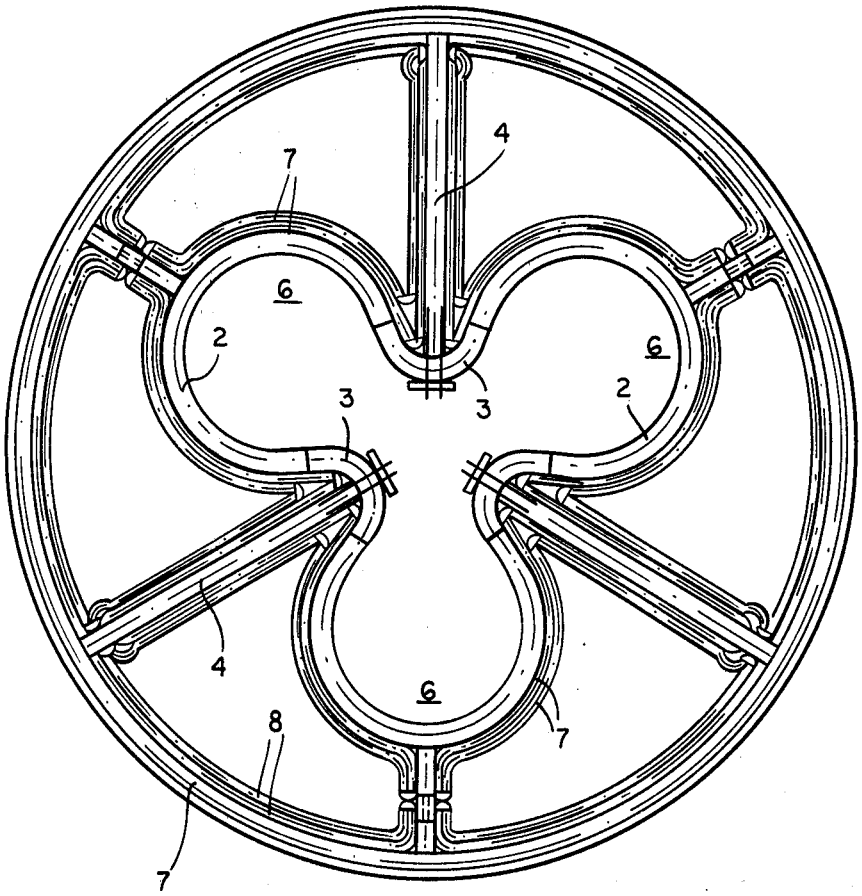
FIG. 3 is a top view showing another tube arrangement for a cover according to the present invention.

FIG. 3 shows how the tube-sections 2 and 3 can be backed up by further cooling tubes 7 which serve a purely cooling function, rather than a combined cooling and structural function like the sections 2 and 3. In addition further such tubes 8 can back up the legs 4 and outer collar 1 so that the cover can be used even in very high-temperature applications.

The tubes 5 lie immediately against each other, and are soldered or welded to segmental cover plates 16. Thus the entire assembly is quite rigid.

The system according to the instant invention therefore cools right up to the edges of the passages provided for the electrodes and the vent pipe. The structural parts forming these passages are themselves internally cooled, so that the system will operate quite efficiently.

I claim:

1. A cover for a metallurgical vessel, said cover comprising:

an annular outer tubular collar defining a center;

a plurality of tubular legs extending inward from said collar toward said center;

an annular inner tubular collar fixed to said legs and defining a plurality of throughgoing electrode passages, said inner collar being formed by respective inwardly concave and substantially circularly arcuate tubular sections defining said passages and each defining a respective one of the electrode passages and respective inwardly convex and tubular elbow sections carried on said legs between said passages and forming an undulating annulus with said inwardly concave sections;

a multiplicity of cooling tubes extending between said collars and legs and connected thereto; and means for circulating a coolant through said tubes, collars, and legs.

2. The cover defined in claim 1, further comprising at least one second cooling tube, distinct from the first-mentioned cooling tubes, extending along said inner collar on the side turned toward said outer collar.

3. The cover defined in claim 1, further comprising a center collar concentric with said outer collar, lying within said inner collar, and formed of center-collar tubes connected to said inner collar and to said means for circulation of said coolant through said center collar.

4. The cover defined in claim 3 wherein said center-collar tubes have vertical tube sections and U-caps connecting same together, said vertical tube sections defining cylinder concentric with said outer collar.

5. The cover defined in claim 1, further comprising heat-resistant tiles secured to said inner collar at said passages.

6. The cover defined in claim 1 wherein said cooling tubes extend angularly between said legs.

* * * * *